US006264515B1

(12) United States Patent
Mineno et al.

(10) Patent No.: US 6,264,515 B1
(45) Date of Patent: Jul. 24, 2001

(54) OUTBOARD MOTOR

(75) Inventors: Kazuo Mineno; Takashi Toyama, both of Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/448,576

(22) Filed: Nov. 23, 1999

(30) Foreign Application Priority Data

Mar. 29, 1999 (JP) ..... 11-086888

(51) Int. Cl.[7] ..... B63H 23/34; B63H 21/38; F01L 1/047

(52) U.S. Cl. ..... 440/83; 440/88; 123/90.31

(58) Field of Search ..... 440/76, 49, 83, 440/900, 88; 123/195 R, 195 P, 90.31

(56) References Cited

U.S. PATENT DOCUMENTS 5,171,177 * 12/1992 Hubbell ..... 440/78
6,045,419 * 4/2000 Mineno et al. ..... 440/49

FOREIGN PATENT DOCUMENTS

10339165 * 12/1998 (JP) ..... 67/6

OTHER PUBLICATIONS

Pending Application.

* cited by examiner

*Primary Examiner*—S. Joseph Morano
*Assistant Examiner*—Andrew Wright
(74) *Attorney, Agent, or Firm*—Morrison Law Firm

(57) ABSTRACT

An outboard motor with an engine where the exposed ends of the crankshaft and camshaft project downward toward the bottom surface of the engine. An accommodation chamber is recessed within the bottom surface of the engine. A chain driven camshaft drive mechanism fits within this accommodation chamber. An oil pump, mounted below the accommodation chamber, is driven by the crankshaft. The bottom end of the crankshaft is sandwiched between the bottom surface of the engine and an oil seal housing. The oil seal housing fits within a recessed opening in a plate-like engine holder positioned below the engine. A plurality of positioning and fastening bosses are used to align and fix the oil seal housing to the engine. When the engine is removed from the outboard motor, its bottom surface is flat enabling the engine sit upright on a workbench.

13 Claims, 5 Drawing Sheets

OUTBOARD MOTOR

BACKGROUND OF THE INVENTION

The present invention relates to an outboard motor used to propel a boat. More specifically it relates to a four-stroke engine mounted within an outboard motor.

In general, outboard motors have an engine mounted on a plate-like engine holder. The engine contains a vertically mounted crankshaft which is rotatably connected to the lower end of the crankshaft. The crankshaft extends downward and drives a screw propeller. Four-stroke engines are more prevalent than two-stroke engines in today's outboard motors due to environmental considerations.

In a four-stroke engine, a camshaft drive mechanism transmits the rotation of the crankshaft to a camshaft located above the engine. Camshaft drive mechanisms generally use a belt drive system. A drive pulley is attached to the upper end of the crankshaft which projects from the upper surface of the engine. A driven pulley is connected to the upper end of the camshaft which projects from the upper surface of the engine. A toothed belt is wrapped around the drive pulley and driven pulley.

The engine is lubricated with an oil pump. The oil pump is mounted at the lower surface of the engine. The oil pump is driven by either the crankshaft or camshaft. The oil is drawn up from the oil pan and distributed within the engine providing lubrication. In order to prevent oil leaks, an oil seal housing containing an oil seal is located along the lower surface of the engine where the crankshaft projects downward.

In conventional outboard motors, however, substantial space must be provided above the engine because the camshaft drive mechanism is located along the upper surface of the engine. This makes it difficult to fit anything else above the engine. Additionally, in such a configuration, the length of crankshaft that must be exposed is relatively long in order to accommodate the drive pulley and fly wheel. This inevitably causes rotational vibration.

On the other hand, if the camshaft drive mechanism is located on the lower part of the engine, the height of the engine increases and this raises the center of gravity of the outboard motor. Also, it is necessary to provide a dedicated casing member to accommodate the camshaft drive mechanism along the bottom surface of the engine. This increases the cost and weight of the outboard motor. It is also more difficult to design and layout the outboard motor engine because the oil pump and the oil seal housing must be adjacent to the camshaft drive mechanism.

OBJECTS AND SUMMARY OF THE INVENTION

It is an object of the present invention to overcome the drawbacks and limitations of the prior art.

It is a further object of the present invention to reduce the overall height needed for the outboard motor.

It is yet a further object of the present invention to provide a camshaft drive mechanism, oil pump and oil seal housing along the lower surface of the engine without increasing its cost or weight.

It is yet a further object of the present invention to improve the design and layout of an outboard motor.

It is yet another object of the invention to improve the ability to attach and detach the oil seal housing while maintaining a good oil seal.

It is yet another object of the present invention to simplify the positioning of the oil seal housing when attaching it to the engine.

It is yet another object of the present invention to improve the start-up characteristics of the engine especially after it is tilted upward.

Briefly stated, the present invention provides an outboard motor with an engine where the exposed ends of the crankshaft and camshaft project downward toward the bottom surface of the engine. An accommodation chamber is recessed within the bottom surface of the engine. A chain driven camshaft drive mechanism fits within this accommodation chamber. An oil pump, mounted below the accommodation chamber, is driven by the crankshaft. The bottom end of the crankshaft is sandwiched between the bottom surface of the engine and an oil seal housing. The oil seal housing fits within a recessed opening in a plate-like engine holder positioned below the engine. A plurality of positioning and fastening bosses are used to align and fix the oil seal housing to the engine. When the engine is removed from the outboard motor, its bottom surface is flat enabling the engine sit upright on a workbench.

According to an embodiment of the invention, there is provided an outboard motor comprising: an engine; an accommodation chamber the accommodation chamber being disposed within a bottom portion of the engine; a camshaft drive mechanism; the camshaft drive mechanism being disposed within the accommodation chamber; and means for rotating the camshaft drive mechanism.

According to another embodiment of the invention, there is provided an engine comprising: an engine body; an accommodation chamber; the accommodation chamber being disposed within a bottom portion of the engine body; a camshaft drive mechanism; the camshaft drive mechanism being disposed fully within the accommodation chamber; and means for rotating the camshaft drive mechanism.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
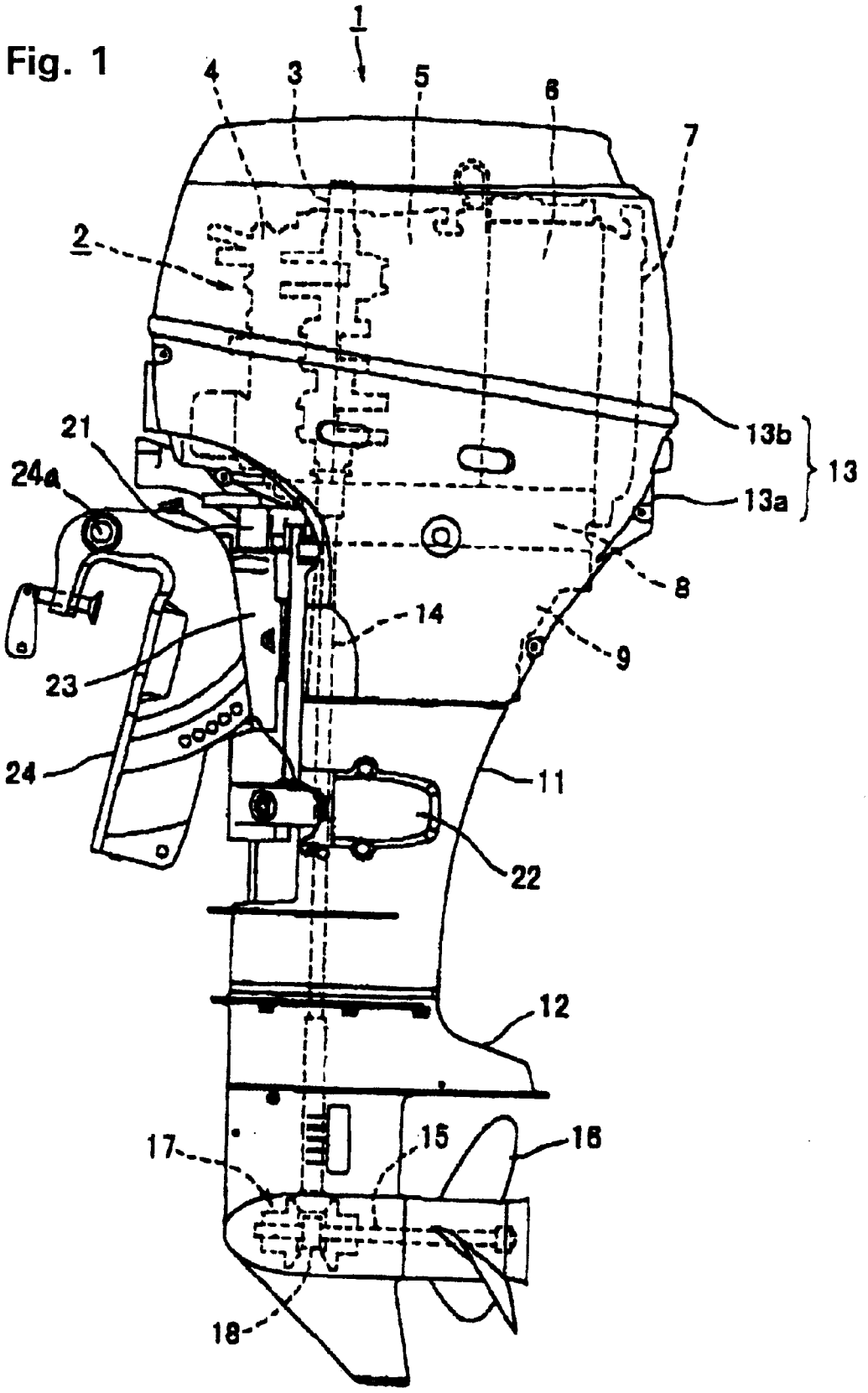
FIG. 1 is a left-side view showing one example of an outboard motor employing one mode of embodiment of the present invention.

Referring to FIG. 1, an outboard motor 1 includes an engine 2 mounted in the upper region of outboard motor 1. Various engines can be used in such an outboard motor 1, but in this embodiment engine 2 is a linear, three cylinder, four stroke engine. Engine 2 is fixed to a plate-like engine holder 8. Engine 2 includes a vertically orientated crankshaft 3 disposed within a crankcase 4. A cylinder block 5 is attached to a cylinder head 6. A head cover 7 encloses cylinder head 6. Engine 2 also includes an oil pan 9 mounted along its lower surface. Attached to the lower part of oil pan 9 is a drive housing 11. A gear housing 12 is disposed below drive housing 11.

Engine 2, engine holder 8 and oil pan 9 are waterproofed by a two-part engine cover 13. Engine cover 13 includes a lower cover 13*a* and an upper cover 13*b*. Lower cover 13*a* is fixed to engine holder 8 and oil pan 9. Upper cover 13*b* is detachably fixed to lower cover 13*a* allowing servicing.

A drive shaft 14 is connected to the bottom end of crankshaft 3. Drive shaft 14 extends downward through engine holder 8, oil pan 9 and drive housing 11 terminating in a gear housing 12. Gear housing 12 encloses a horizontally mounted propeller shaft 15 and a screw propeller 16.

A bevel gear mechanism 17 and a clutch shifter 18 couple drive shaft 14 to propeller shaft 15. The rotation of drive shaft 14 is transmitted to propeller shaft 15 via bevel gear mechanism 17 rotating screw propeller 16. The rotation of screw propeller 16 provides the motive force. Because drive shaft 14 rotates in only one direction, clutch shifter 18 switches the rotation of propeller shaft 15 between forward and reverse. By selecting forward or reverse, the user is able to direct the boat both forward and backward using outboard motor 1.

The upper and lower ends of a swivel shaft 23 are fixed to mounts 21 and 22. Mount 21 is attached to the front edge of engine holder 8. Mount 22 is disposed along the front of drive housing 11. Swivel shaft 23 is axially supported with the freedom to rotate left and right on a clamp bracket 24. Clamp bracket 24 is fixed to the stern of a boat (not shown.) The boat is steered by turning outboard motor 1 left and right about swivel shaft 23. Outboard motor 1 can also be tilted vertically about a tilt shaft 24*a* mounted in clamp bracket 24.

Figure 2:
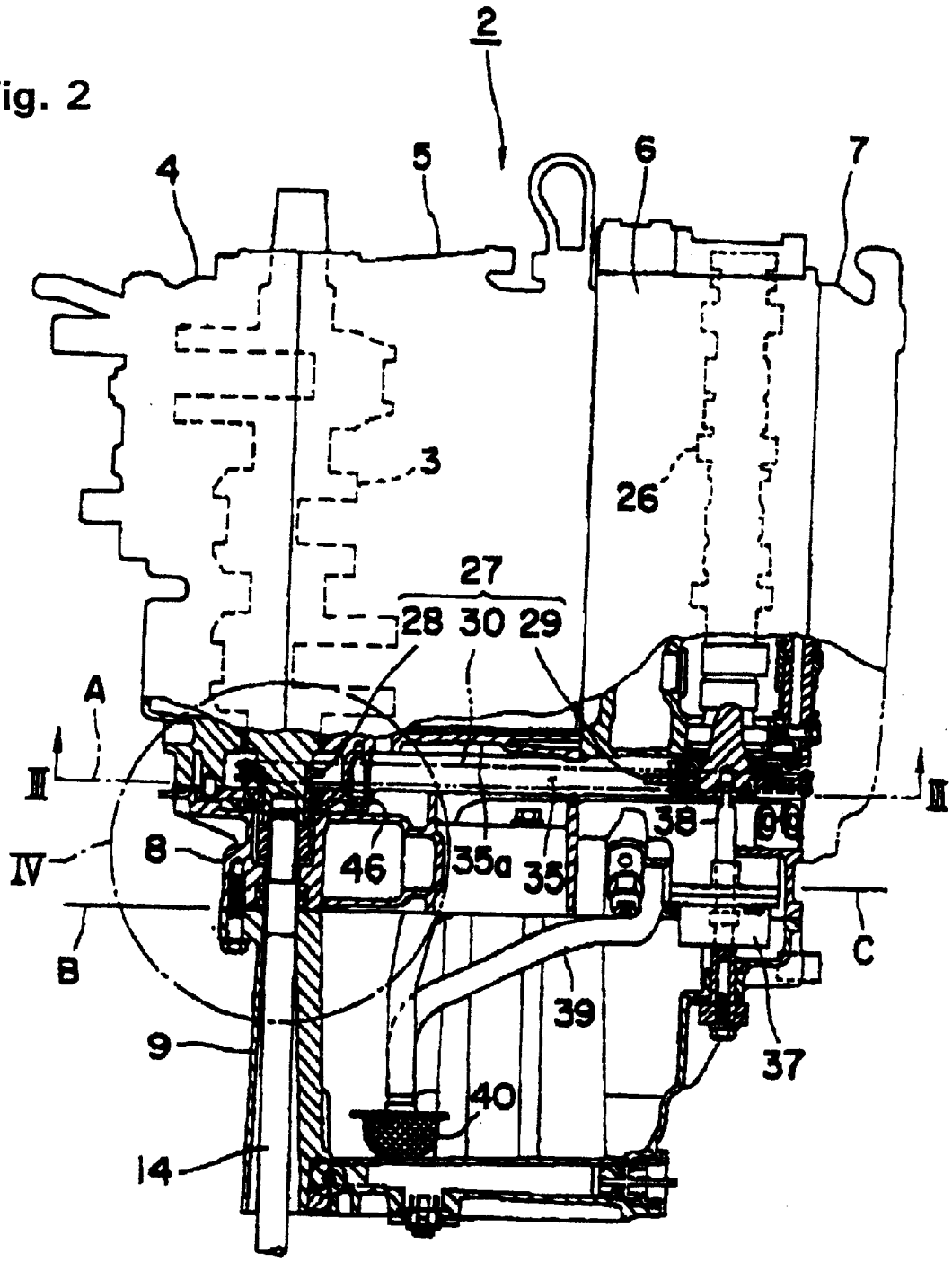
FIG. 2 is an enlarged view showing a portion of the engine the engine holder and oil pan, and is a figure according to one embodiment of the present invention.

Referring to FIG. 2, a camshaft 26 is axially supported and vertically orientated inside cylinder head 6. A valve-drive mechanism (not shown) is driven by the rotation of camshaft 26. The rotation of crankshaft 3 is stepped down by one-half and transmitted to camshaft 26 by means of a chain-drive type camshaft drive mechanism 27 disposed in the lower part of engine 2.

Figure 3:
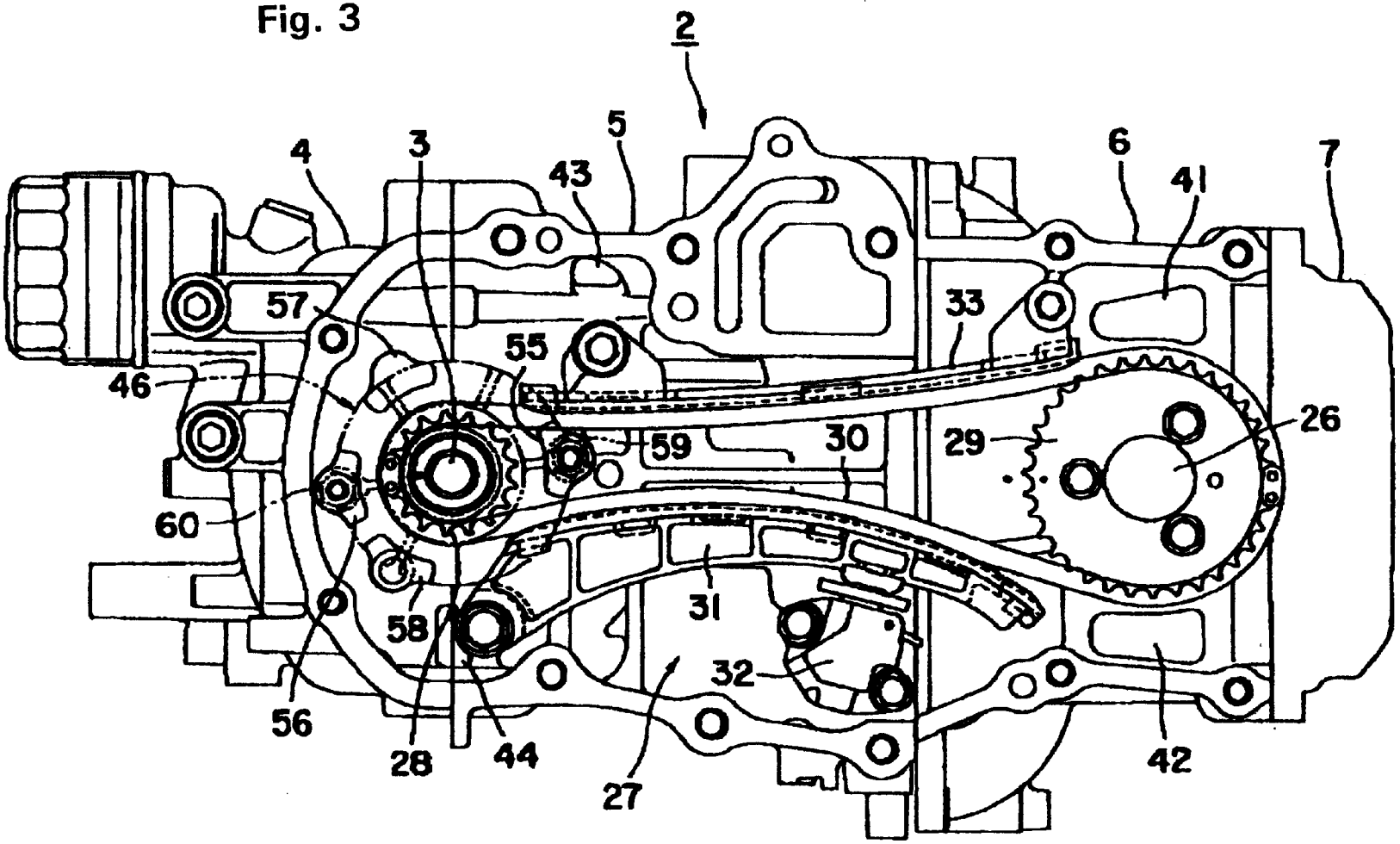
FIG. 3 is a bottom view of the engine taken along arrows III—III of FIG. 2.
Figure 4:
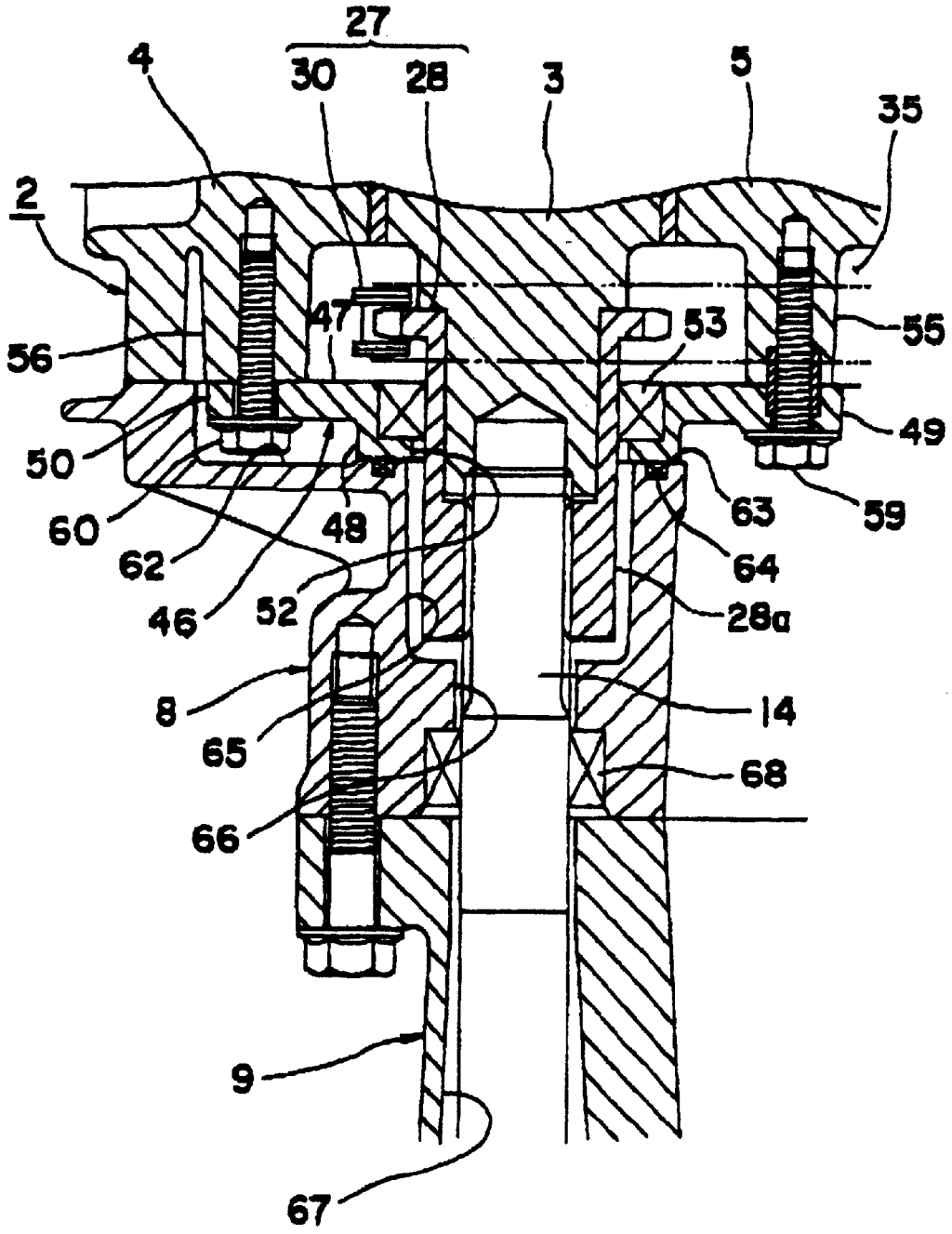
FIG. 4 is an enlarged view of the area IV of FIG. 2.

Referring now to FIGS. 3 and 4, a drive sprocket 28 connects the lower end of crankshaft 3 projecting from the lower surface of engine 2. A driven sprocket 29 is connected to the lower end of camshaft 26 which also projects from the lower surface of engine 2. A timing chain 30 links drive sprocket 28 to driven sprocket 29. The tension of timing chain 30 is adjusted using a chain tensioner 31 and a chain adjuster 32 disposed along the lower surface of engine 2. Timing chain 30 is guided with a chain guide 33. Note that the ratio of teeth between drive sprocket 28 and driven sprocket 29 is set at 1:2.

Referring to FIGS. 2 and 3, camshaft drive mechanism 27 fits within an accommodation chamber 35. Accommodation chamber 35 is disposed within engine 2 and engine holder 8. A recess 35*a* is formed within the lower surface of engine 2. Camshaft drive mechanism 27 fits within accommodation chamber 35 and recess 35*a* located above an upper joining surface A of engine holder 8.

When engine 2 operates, drive sprocket 28 rotates together with crankshaft 3. Timing chain 30 drives driven sprocket 29 which turns camshaft 26. Camshaft 26 rotates at half the speed of crankshaft 3. The tension of timing chain 30 is regulated by chain adjuster 32 pressing on chain tensioner 31.

An oil pump 37 is disposed at the bottom of camshaft 26. Oil pump 37 is fixed to the lower surface of engine holder 8. A fixing surface C is disposed between camshaft drive mechanism 27 and a lower joining surface B of engine holder 8. A main shaft 38 of oil pump 37 extends upwards and is connected to the lower end of camshaft 26. An oil intake pipe 39 extends downwards towards the floor of oil pan 9. An oil strainer 40 is attached to the end of oil intake pipe 39. Oil pools inside oil pan 9.

Oil pump 37 is driven by the rotation of camshaft 26. Oil pump 37 draws the pooled oil through oil intake strainer 40 and up oil intake pipe 39 lubricating engine 2. After lubricating engine 2, the oil naturally drains back into oil pan 9 through a plurality of oil returning holes 41, 42, 43 and 44.

Figure 5:
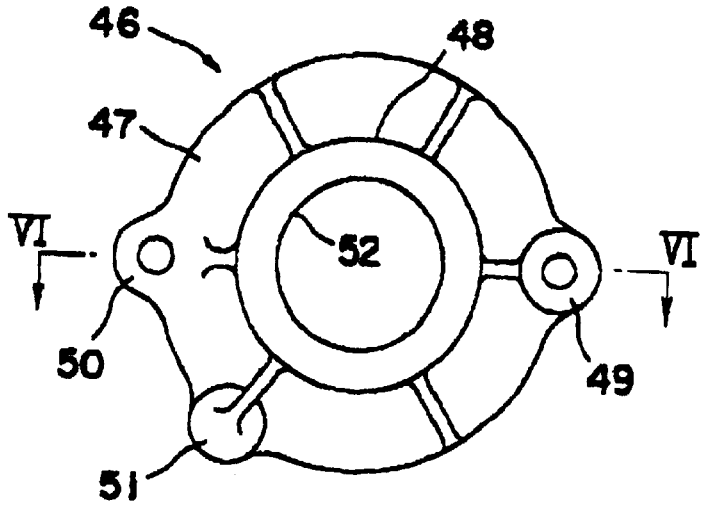
FIG. 5 is a bottom view of the oil seal housing.
Figure 6:
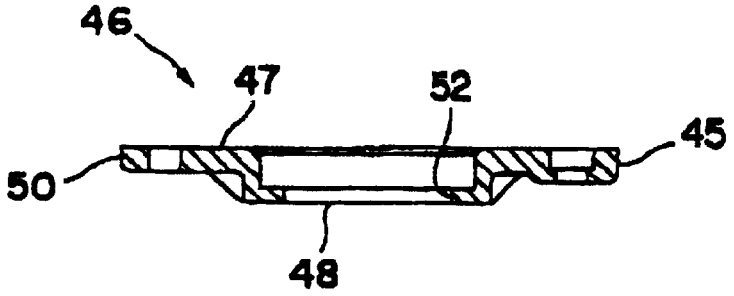
FIG. 6 is a longitudinal cross section of an oil seal housing along the line VI—VI of FIG. 5.
Figure 7:
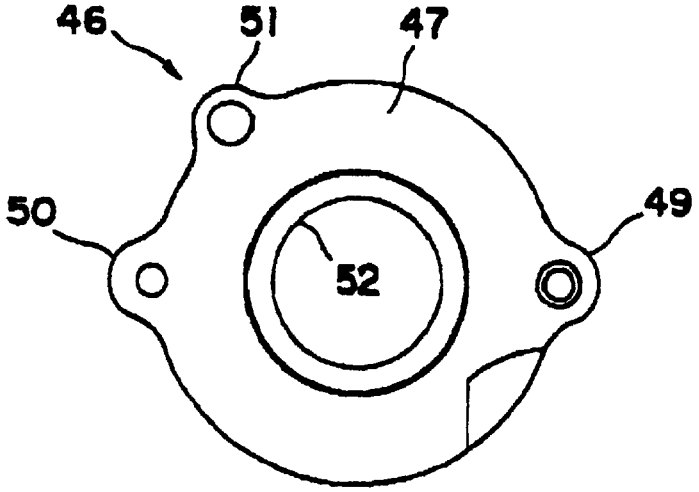
FIG. 7 is a top view of an oil seal housing.

Referring to FIGS. 5, 6 and 7, an oil seal housing 46 at the bottom of engine 2 is equipped with a fixing flange 47. Fixing flange 47 is fixed to the bottom of engine 2. A seal holder 48 centrally projects from fixing flange 47. Fixing flange 47 is bolted to engine 2 by two bolt fasteners, 49 and 50 and a positioner 51. A centrally located shaft hole 52 is disposed above seal holder 48. Seal holder 48 is fitted with an oil seal 53 (see FIG. 4.)

Referring again to FIGS. 3 and 4, a pair of fastening bosses 55 and 56 project from the lower surface of cylinder block 5 and crankcase 4, sandwiching crankshaft 3. Fastening boss 55 is located inside the area bounded by timing chain 30. A pair of positioning bosses 57 and 58 are disposed to the left and right of fastening boss 56.

Fastening bosses 55 and 56 and positioning bosses 57 and 58 extend below camshaft drive mechanism 27 and timing chain 30. The lower surfaces of fastening bosses 55 and 56 and positioning bosses 57 and 58 are used to attach oil seal housing 46. Bolt fasteners 49 and 50 of oil seal housing 46 are matched respectively to fastening bosses 55 and 56. Positioner 51 aligns with positioning boss 58 and a knock pin (not shown) is inserted. Bolt-fasteners 49 and 50 are attached to fastening bosses 55 and 56 with bolts 59 and 60. This arrangement positions and secures oil seal housing 46 to engine 2.

Oil seal housing 46 is lower than both camshaft drive mechanism 27 and the lower end of crankshaft 3. A sleeve 28*a* is part of drive sprocket 28. Sleeve 28*a* passes through seal holder 48 which passes through shaft hole 52 of oil seal housing 46. Oil seal 53 fits within seal holder 48 and presses against the outer surface of sleeve 28*a*. Other configurations could also be used such as having oil seal 53 press against the outer surface of the lower end of crankshaft 3.

A housing recess 62 disposed on the upper surface of engine holder 8 surrounds oil seal housing 46. The lower surface of seal holder 48 of oil seal housing 46 joins with an inner flat surface 63 of housing recess 62. This joint is made liquid-tight using a packing material such as an O-ring 64.

Housing recess 62 includes a cylindrical recess 65 and a shaft hole 66. Shaft hole 66 is concentric with but smaller in diameter than cylindrical recess 65. Shaft hole 66 aligns with a shaft chamber 67 disposed within oil pan 9 and drive housing 11 (FIG. 1.) Sleeve 28*a* of drive sprocket 28 fits within cylindrical recess 65. Drive shaft 14 connects with sleeve 28*a* and passes through shaft hole 66 and shaft chamber 67. An oil seal 68 fits against the inner circumference of shaft hole 66 and presses against the outer circumferential surface of drive shaft 14.

The pooled oil inside oil pan 9 and the oil flowing down from engine 2 is sealed by oil seal 53 disposed in oil seal housing 46, O-ring 64 on inner flat surface 63 of housing recess 62, and oil seal 68 disposed within shaft hole 66. The above combination is extremely effective at sealing the oil in and keeping the oil from leaking into cylindrical recess 65, shaft hole 66 and shaft chamber 67. In an outboard motor as described above, camshaft drive mechanism 27 fits within camshaft drive mechanism accommodation chamber 35 disposed within engine 2 and engine holder 8. With this configuration, the need for a separate dedicated casing member to contain camshaft drive mechanism 27 is eliminated. This reduces the overall height and weight of engine 2, as well as lowering production costs.

Camshaft drive mechanism accommodation chamber 35 includes recess 35*a* located in the lower surface of the engine 2. Camshaft drive mechanism 27 fits within accommodating recess 35*a* and thus camshaft drive mechanism 27 is actually located above upper joining surface A of engine holder 8. This reduces the thickness of the engine holder 8, further lowering the overall height of engine 2. It is to be noted that because camshaft drive mechanism 27 fits entirely within engine 2, the bottom surface is flat. When engine 2 is removed from outboard motor 1 and placed on a work bench, it is stable and easy to work on.

A further reduction in height is achieved by utilizing a chain drive system camshaft drive mechanism 27. The present invention's chain drive mechanism is thinner than conventional belt drive systems, therefore overall height is further reduced.

The present invention fixes oil pump 37 to engine holder 8. This configuration reduces the overall height of engine 2 over conventional engines where the oil pump is located on the lower surface of the engine. Oil pump 37 is attached to fixing surface C. Fixing surface C is below cam shaft drive mechanism 27, but above lower joining surface B. This allows oil pump 37 to be separate from cam shaft drive mechanism 27. This makes it easier to lay out parts in engine 2. It also improves the performance of oil pump 37. Oil pump 37 is closer to oil pan 9. This reduces the oil intake lift which improves the lubrication of engine 2.

Additionally, the present invention reduces the overall height of engine 2 by locating oil seal housing 46 below camshaft drive mechanism 27 while at the same time allowing oil seal housing 46 to fit within housing recess 62 (located on the upper surface of engine holder 8.) This configuration also allows oil seal housing 46 to be separate from camshaft drive mechanism 27 making it easier to lay out parts in engine 2.

The lower surface of oil seal housing 46 is liquid-tight because O-ring 64 presses against inner flat surface 63 of housing recess 62. This reliably seals the oil inside engine 2 side and prevents oil leaks. Also, because oil pump 37 is driven by camshaft drive mechanism 27, oil pump 37 and oil seal housing 46 are located apart from each other. This makes it is easier to lay out parts in engine 2.

Fastening bosses 55 and 56 are located in cylinder block 5 and crank case 4, sandwiching crankshaft 3. Bolts 59 and 60 fix oil seating housing 46 to engine 2. Because fastening boss 55 is located within an area bounded by timing chain 30, it remains accessible without disturbing timing chain 30. This allows oil seal housing 46 to be attached and detached without removing timing chain 30 making maintenance easier.

Also, because positioning bosses 57 and 58 adjoining fastening boss 56 have a gap from fastening boss 56, it is simpler to position oil seal housing 46. Additionally, when outboard motor 1 is tilted up about tilt shaft 24*a* of clamp bracket 24, oil flows between fastening boss 56 and positioning bosses 57 and 58 emptying oil seal housing 46. Because the oil is returned to oil pan 9, engine 2 is satisfactorily lubricated even after being tilted. This lowers mechanical losses and improves the starting ability of engine 2.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An outboard motor comprising:

an engine mounted directly on an engine holder;

an accommodation chamber;

said accommodation chamber being delimited by a bottom portion of said engine and said engine holder;

a camshaft drive mechanism;

said camshaft drive mechanism being disposed within said accommodation chamber; and means for rotating said camshaft drive mechanism.

2. An outboard motor according to claim 1, wherein said means for rotating said camshaft drive mechanism further comprises:

a crankshaft;

means for rotating said crankshaft; and said crankshaft being rotatably connected to said camshaft drive mechanism.

3. An outboard motor according to claim 2, wherein said crankshaft is generally vertical; and a lower end of said crankshaft projects downward from a bottom surface of said engine.

4. An outboard motor according to claim 3, further comprising:

a camshaft;

said camshaft being rotatably connected to said camshaft drive mechanism;

an oil pump; and said oil pump being driven by said camshaft.

5. An outboard motor according to claim 4 wherein said oil pump is mounted lower than said camshaft drive mechanism; and said oil pump is mounted higher than a lower surface of said engine holder.

6. An outboard motor according to claim 3, further comprising:

a housing recess;

said housing recess being disposed within said engine holder and open at a top surface of said engine holder;

an oil seal housing; and said oil seal housing being disposed below said camshaft drive mechanism and fitting within said housing recess.

7. An outboard motor according to claim 6, further comprising:

means for liquid-tight sealing a lower surface of said oil seal housing against an upper flat surface of said housing recess.

8. An outboard motor according to claim 7, further comprising:

a plurality of fastening bosses projecting from a lower surface of said engine;

said plurality of fastening bosses having base ends being lower than said accommodation chamber and said lower end of said crankshaft; and a plurality of bolts fitting through said oil seal housing and threadably fitting into said plurality of fastening bosses sandwiching said lower end of said crankshaft between said oil sealing housing and said plurality of fastening bosses.

9. An outboard motor according to claim 8, further comprising:

a plurality of positioning bosses projecting from a lower surface of said engine;

a plurality of positioning receptacles disposed within said oil seal housing;

said plurality of positioning bosses lining up with said plurality of positioning receptacles; and a gap disposed between said plurality of fastening bosses and said plurality of positioning bosses.

10. An outboard motor according to claim 1, wherein said camshaft drive mechanism is a chain drive camshaft mechanism.

11. An outboard motor according to claim 1, wherein said engine is a four-stroke engine.

12. An outboard motor according to claim 1, wherein a bottom surface of said engine is flat.

13. An engine comprising:

an engine body directly attached to an engine holder;

an accommodation chamber;

said accommodation chamber being delimited by a bottom portion of said engine body and said engine holder;

a camshaft drive mechanism;

said camshaft drive mechanism being disposed fully within said accommodation chamber; and means for rotating said camshaft drive mechanism.

* * * * *